United States Patent [19]

Waters

[11] Patent Number: 4,682,656

[45] Date of Patent: Jul. 28, 1987

[54] COMPLETION APPARATUS AND METHOD FOR GAS LIFT PRODUCTION

[75] Inventor: Fleming A. Waters, Coppell, Tex.

[73] Assignee: Otis Engineering Corporation, Dallas, Tex.

[21] Appl. No.: 876,700

[22] Filed: Jun. 20, 1986

[51] Int. Cl.[4] ..... E21B 23/02; E21B 33/119; E21B 34/10; E21B 43/12

[52] U.S. Cl. ..... 166/372; 166/117.5; 166/133; 166/143; 166/375; 166/387

[58] Field of Search ..... 166/131, 133, 184, 185, 166/143, 149, 151, 372, 373, 375, 117.5, 105.5, 387

[56] References Cited

U.S. PATENT DOCUMENTS

| | | | |
|---|---|---|---|
| 2,776,013 | 1/1957 | Tausch | 166/185 X |
| 2,963,089 | 12/1960 | Sizer | 166/72 |
| 3,375,874 | 4/1968 | Cherry et al. | 166/114 |
| 3,871,456 | 3/1975 | Sizer et al. | 166/298 |
| 4,143,712 | 3/1979 | James et al. | 166/72 |
| 4,183,404 | 1/1980 | James et al. | 166/133 |
| 4,294,313 | 10/1981 | Schwagman | 166/117.5 |
| 4,295,796 | 10/1981 | Moore | 166/117.5 X |
| 4,416,330 | 11/1983 | Merritt et al. | 166/117.5 |
| 4,448,216 | 5/1984 | Speegle | 137/630 |
| 4,449,587 | 5/1984 | Rodenberger et al. | 166/323 |
| 4,480,697 | 11/1984 | Goldaniga et al. | 166/372 |
| 4,540,047 | 9/1985 | Akkerman | 166/131 X |
| 4,589,482 | 5/1986 | Bayh, III | 166/105.5 |

*Primary Examiner*—Stephen J. Novosad

*Attorney, Agent, or Firm*—Glaser, Griggs & Schwartz

[57] ABSTRACT

A tubing retrievable completion assembly includes a surface-controllable, safety control valve interposed between the production tubing string and a production seal unit. A gas-lift safety valve is carried within a side pocket mandrel connected in the upper production string. The upper production string, production flow safety valve and gas-lift safety valve are run in and removed as a single unit from a single-bore hanger packer which is releasably anchored within the well casing. Separate concentric flow passages are provided through the packer bore for the upward flow of formation fluid through a production stinger conduit which extends through the packer bore, and for downward flow of lift gas through the annulus between the packer bore and the stinger conduit. The completion assembly is locked into place below the hanger packer by a latch having fixed and movable collets. Pressure equalization across the packer is obtained by closure of the gas lift safety valve and opening of an equalization valve whereby lift gas from the lower casing annulus is vented into the production tubing string.

9 Claims, 8 Drawing Figures

COMPLETION APPARATUS AND METHOD FOR GAS LIFT PRODUCTION

FIELD OF THE INVENTION

This invention relates generally to well completion and production, and in particular to method and apparatus for completing and producing a gas lift well.

BACKGROUND OF THE INVENTION

Gas lift is a commonly-used method for producing wells which are not self-flowing. Gas lift consists of initiating or stimulating well flow by injecting gas at some point below the fluid level in the well. In some gas lift operations, gas is conducted to the point of injection through an axillary string of tubing. When gas is injected into the formation fluid column, the weight of the column above the point of injection is reduced as a result of the space occupied by the relatively low-density gas. This lightening of the fluid column is sufficient in some wells to permit the formation pressure to initiate flow up the production tubing to the surface. Gas injection is also utilized to increase the flow from wells that will flow naturally but will not produce the desired amount by natural flow.

There are numerous gas lift arrangements, including various designs for flow valves which may be installed in the tubing string in open and inject gas in response to a predetermined pressure differential between the casing tubing annulus and the production tubing. When the valve opens, gas is injected into the tubing to initiate and maintain flow until the production tubing pressure drops to a predetermined value. The valve is set to close before the input gas/oil ratio becomes excessive. Other valve arrangements are designed to maintain continuous flow, proper pressure differential, and proper gas injection rate for efficient operation, and safety shut-down.

DESCRIPTION OF THE PRIOR ART

Surface-controlled subsurface safety valves are commonly used in oil and gas wells to provide downhole protection is a failure or hazardous condition should occur at the well surface. Such safety valves are typically fitted into the production tubing and operate to block the flow of formation fluid upwardly through the production tubing. The safety valve provides for automatic shut-off of production flow in response to one or more well safety conditions that can be sensed and/or indicated at the surface, for example, a fire on the platform, high/low pressure condition, high/low temperature condition, and operator override. During production, the subsurface safety valve is held open by the application of hydraulic fluid pressure conducted to the safety valve through an auxillary conduit which is extended along the tubing string within the annulus between the tubing and the well casing.

In gas-lift operations, the well may be produced through either the casing or the tubing. If the well is produced through the casing, the lift gas is conducted through a tubing string to the point of injection, and if the well is produced through production tubing, the gas is conducted to the point of injection through the casing annulus or through an auxillary tubing string.

In some gas-life wells, the lift gas is conducted through an auxillary tubing string. The auxillary gas lift string is run in with the production tubing string in an arrangement which requires a dual packer in which separate packer flow paths are provided for the lift gas and the production flow. Such twin flow packers inherently limit the production bore diameter. Moreover, the completion of such dual packer arrangements is made difficult by the orientation and alignment requirements for stabbing the dual production and lift gas conductors into the separate landing bores of the dual packer. Latch and release are likewise complicated by the engagement of dual flow conductors within the landing bores of the dual packer.

In prior installations, the upper production tubing string is provided with a safety valve connected therein, and control fluid conduits along with the gas lift tubing are separately installed and anchored to the upper end of the dual packer. In such dual packer installations, there is a risk of disturbing the packers and the flow conductors in the well while performing the installation and removal of the safety valves and upper tubing sections. Such prior installations have not provided means for equalizing or relieving the lift gas pressure from the casing annulus below the packer to accomodate a well operating condition in which it is necessary to pull or service the subsurface gas-lift safety valve. Relief and/or equalization is essential for safe wire line servicing in large-volume gas-lift operations because of the high gas pressure levels which are developed within the casing annulus below the hanger packer.

OBJECTS OF THE INVENTION

It is, therefore, an object of the invention to provide an improved subsurface safety valve installation for use in a gas lift well.

A related object of the invention is to provide an improved surface-controlled subsurface safety valve system for use in a gas-lift well which has been previously completed with a flow conductor in place therein.

Another object of the invention is to provide method and apparatus of the character set forth wherein the upper tubing string and production flow safety valve along with a gas lift flow conduit and gas lift safety valve can be run in and removed as a single unit from a single bore hanger packer.

Still another object of the invention is to provide method and apparatus of the character described wherein the installation of a tubing string, production safety valve and gas lift safety valve can be installed without rotary manipulation of flow conductors in place in the well, and wherein the surface-controlled subsurface safety valve and replacement upper flow tubing string may be removed and replaced without rotation.

Yet another object of the invention is to provide improved well completion apparatus for use in a gas-lift well for conducting lift gas from a surface facility through a single-bore packer into the casing annulus below the packer.

A related object of the invention is to provide a method and apparatus of the character set forth wherein means are provided for equalizing or relieving the lift gas pressure from the casing annulus below the packer to accomodate a well operating condition in which it is necessary to wire line service the gas-lift safety valve.

Yet another object of the invention is to provide improved well completion method and apparatus of the character set forth wherein production tubing, gas-lift tubing and control fluid conduits can be run in, landed and removed as a unit from a single-bore packer substantially without risk of damage to the packer and the associated flow conductors while affecting the installation and/or removal of the upper tubing string.

Another object of the invention is to provide an improved surface-controllable subsurface safety valve system for use in a gas-lift well installation in which the safety valves, safety valve control conduits and gas-lift tubing are retrievable as a unit along with the production string.

An important object is to provide improved method and apparatus of the character set forth wherein a production safety valve and a gas-lift safety valve are both installed, operable and retrievable above a hanger-type packer.

Still another object of the invention is to provide well completion apparatus in which separate flow passages are provided for lift gas and production fluids through a single-bore packer substantially without limiting or restricting production flow through the packer, while simultaneously providing an adequate lift gas flow path through the packer.

Yet another object of the invention is to provide method and apparatus of the character set forth wherein means are provided for simplifying the latch and release of the production tubing, safety valve and gas-lift assembly with respect to the hanger packer.

A further object of the invention is to provide an improved production seal unit for releasably engaging a single bore packer and providing separate fluid flow passages for a production tubing string in which a surface-controllable. subsurface safety valve is installed in a lift gas flow conduit, respectively, wherein formation fluid and lift gas are conducted through the single bore packer along separate flow paths.

SUMMARY OF THE INVENTION

The foregoing objects are provided by a tubingretrievable completion assembly in which a production seal unit is connected to a production tubing string suspended from the well head. A surface-controllable, safety control valve is interposed between the production tubing and the production seal unit. A gas-lift safety valve is mounted or releasably secured in a side pocket mandrel. The side pocket mandrel has a production bore connected in the production string. The upper tubing string, production flow safety valve, gas-lift flow conduit and gas-lift safety valve can be run in and removed as a single unit form a single-bore hanger packer which is releasably anchored within the well casing.

According to one aspect of the invention, the well casing annulus above the packer is pressurized with lift gas, which is admitted through the gas-lift safety valve. The lift gas is conducted through a conduit to a small diameter flow passage in the production seal unit. The production seal unit is provided with a large-diameter central bore to which a production stinger conduit is connected. An annular coupling collar is attached to the lower end of the production seal unit and engages in telescoping, sealing relation with the internal landing bore of the hanger packer.

The small-diameter gas-lift flow passage opens into the annulus between the sealing collar and the stinger conduit. The annulus between the packer bore and the stinger conduit defines a separate flow path which opens into the well casing annulus below the packer. Atatched to the lower end of the packer and concentrically disposed about the stinger conduit is a stinger nipple to which the lower production string is connected. A latch mandrel is attached to the lower end of the stinger conduit. Mutually co-acting latching members are carried by the latch mandrel and by the stinger nipple for releasably securing the production seal unit onto the hanger packer. The stinger nipple includes an annular latch groove and a seal bore. The annular interface between the stinger nipple bore and the latch mandrel is sealed by an annular seal.

According to the foregoing arrangement, separate flow passages are provided through the packer bore for the upward flow of production fluid through the production stinger conduit and for downward flow of lift gas through the annulus between the packer bore and the stinger conduit.

At the onset of a well head condition requiring the shut-off of production flow, the production safety valve and gas-lift safety valve are automatically closed. This blocks the flow of formation fluid through the production tubing string, and shuts off the flow of pressurized gas from the annulus below the hanger packer to the casing tubing annulus above the hanger packer. If it is necessary to service the gas-lift safety valve, a normally-closed gas-lift equalization valve is opened by a wire line service tool. High-pressure lift gas from the lower casing annulus is released through the equalization valve into the production tubing string. This provides for equalization of the pressure differential across the packer so that wire line service operations can be performed safely.

Other objects and advantages of the present invention will be appreciated by those skilled in the art upon reading the detailed description which follows with reference to the attached drawings.

DETAILED DESCRIPTION OF THE PREFERRED EMBODIMENT

Figure 1A:
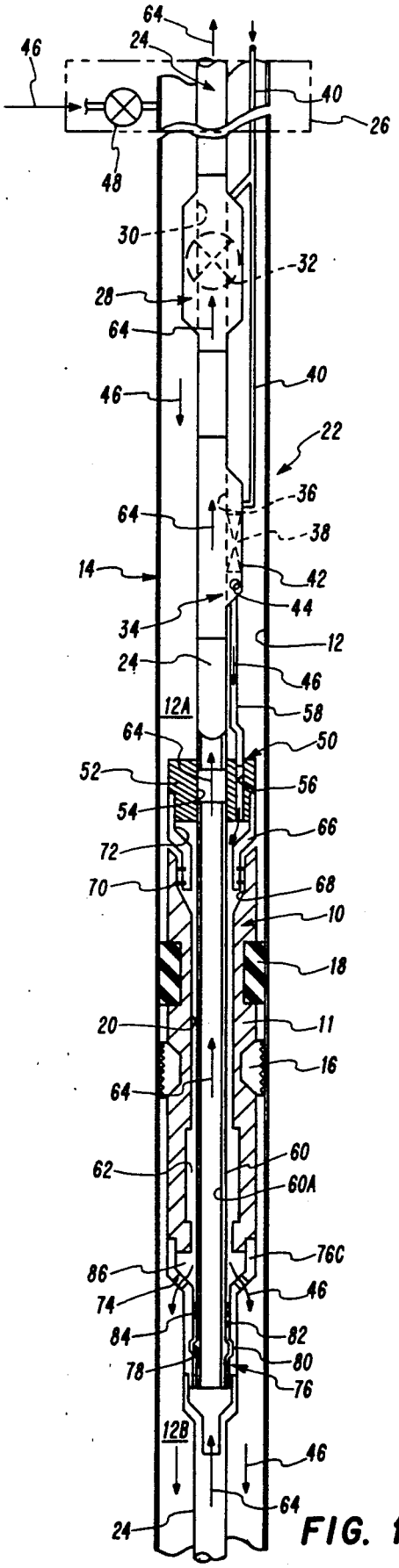
FIG. 1A is a view, partly in section and partly in elevation, showing a typical gas-lift well installation in which the tubing-retrievable completion assembly of the present invention is shown landed within a single-bore hanger packer.

In the description which follows, like parts are marked throughout the specification and drawings with the same reference numerals, respectively. The drawings are not necessarily to scale and the proportion of certain parts has been exaggerated to better illustrate details of the present invention.

Referring now to FIG. 1A, the tubing-retrievable completion assembly of the invention is illustrated and described in connection with a gas-lift installation in which a hanger packer 10 is releasably anchored at an appropriate depth within the bore 12 of a well casing 14. The packer 10 is provided with a mandrel 11 having mechanically or hydraulically-actuated slips 16 which set the packer against the bore 12 of the well casing 14. The casing annulus is sealed above and below the packer by expanded seal elements 18, thereby dividing the casing annulus into an upper region 12A and a lower region 12B. The packer mandrel 11 has a large-diameter, central bore 20 through which production flow and lift gas flow are separately conducted as hereinafter described.

Figure 2:
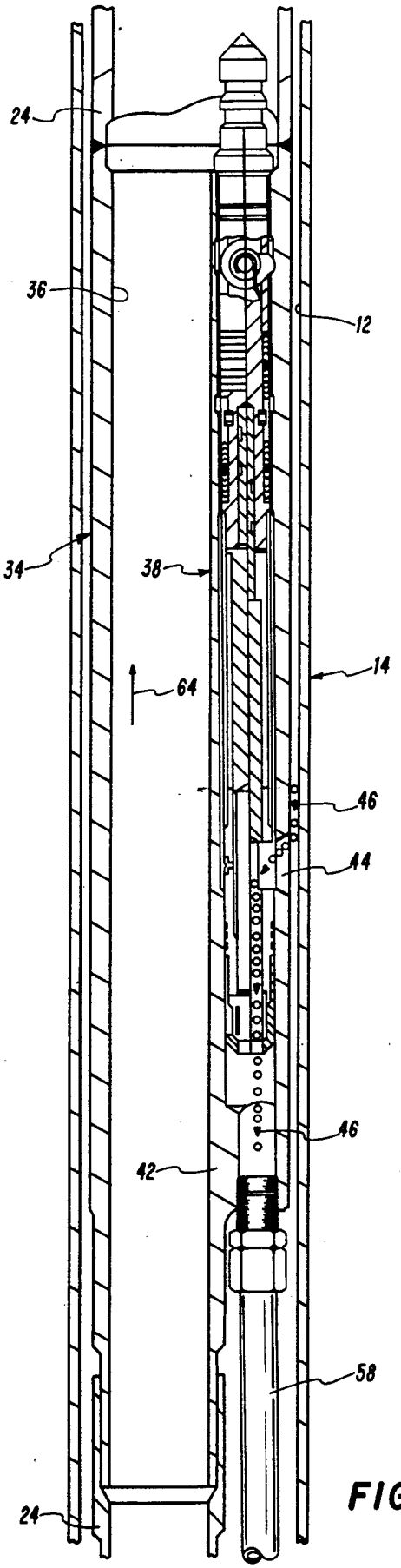
FIG. 2 is a longitudinal sectional view of the gaslift safety valve and side pcocket mandrel assembly shown in FIG. 1.

A tubing-retrievable completion assembly 22 is connected to a production tubing string 24 which is suspended from well head equipment 26. A surface-controlled, subsurface safety valve 28 having a production bore 30 and a movable valve closure element 32 is connected in series with the production tubing 24. Connected below the production safety valve 28 is a lift gas safety valve assembly 34 having a production bore 36 connected in series with the production tubing 24. The lift gas safety valve assembly 34 includes a hydraulically-actuated valve 38 which is coupled in fluid communication with a hydraulic flow control line 40. The safety valve 38 is received within a side pocket mandrel 42 which has an inlet port 44 through which lift gas 46 is admitted from the upper casing annulus 12A. The flow path of the lift gas 46 through the safety valve 38 is shown in greater detail in FIG. 2.

The production safety valve 28 is preferably of the flapper type as described in U.S. Pat. No. 4,449,587 to Charles M. Rodenberger, et al, or it may be of the ball valve closure type as described in U.S. Pat. No. 4,448,216 to Speegle, et al. Both of these patents are incorporated by reference for all purposes within this application.

An example of a hydraulically-actuated lift gas safety valve 38 and side pocket mandrel 42 which are satisfactory for use in this invention are shown in U.S. Pat. No. 4,294,313 to Harry E. Schwegman, and U.S. Pat. No. 4,589,482 to Russell I. Bayh III, which are hereby incorporated herein for all purposes.

The well casing annulus 12A above the packer 10 is pressurized with lift gas 46, which is conducted into the casing annulus through a valve 48 located at the well head 26. The hydraulic flow control ine 40 connects the production safety valve 28 and lift gas safety valve 34 in fluid communication with a surface control unit located at the well head 26, which supplies hydraulic fluid under pressure from a pump. Removal of hydraulic pressure from the control line 40 causes automatic release of spring-loaded flapper closure elements in both safety valve. The well head 26 includes a casing head through which the packer 10 and the completion assembly 22 are inserted into the well casing and which prevents the flow of fluids from the well casing annulus.

Figure 3:
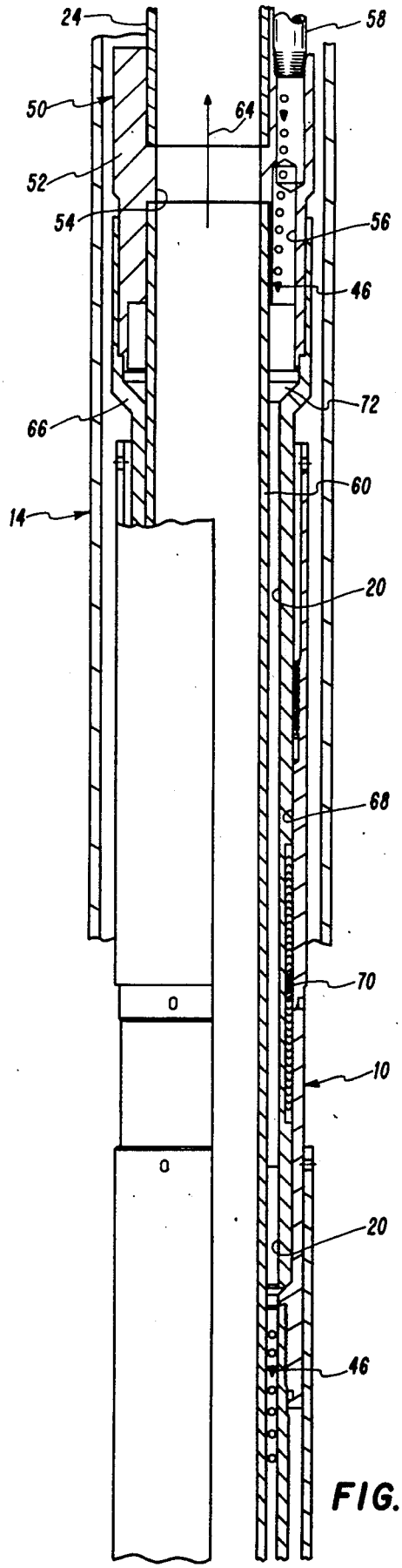
FIG. 3 is a view, partly in section and partly in elevation, showing engagement of the production seal unit with the bore of the hanger packer shown in FIG. 1.
Figure 4:
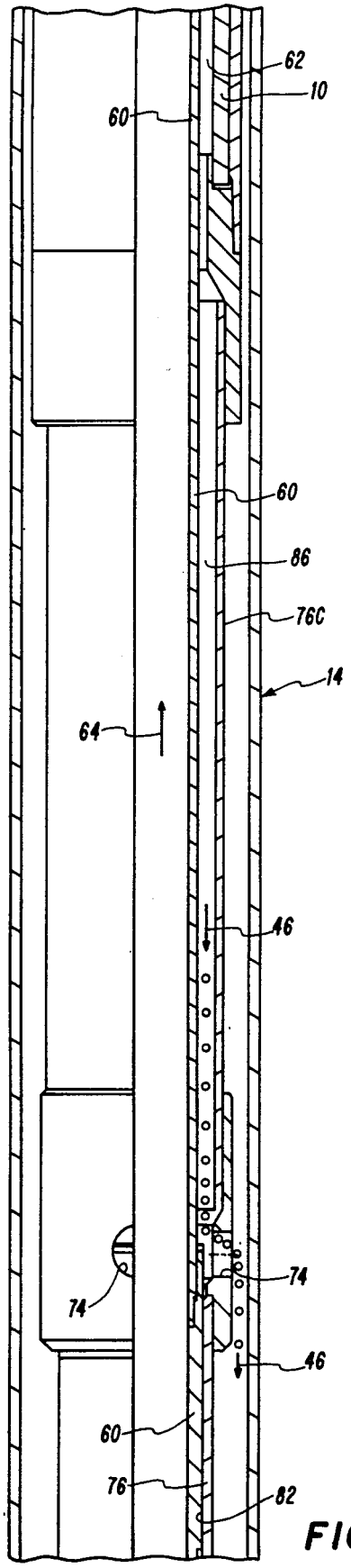
FIG. 4 is a view, partly in section and partly in elevation, illustrating the flow path for lift gas into the lower casing annulus below the hanger packer.

Referring now to FIGS. 1A and 3, an intermediate component of the tubing-retrievable completion assembly 22 is a production seal unit 50 which is connected to the production tubing string 24. The production seal unit 50 includes a twin flow coupling head 52 which is intersected by a large-diameter production bore 54, The coupling head 52 of the production seal unit 50 also includes a small-diameter flow passage 56 for conducting lift gas 46 admitted by the lift gas safety valve 34. The lift gas 46 is conducted from lift gas safety valve 34 by a small conduit 58 which connects the lift gas safety valve in fluid communication with the small-diameter flow passage 56.

According to an important feature of the invention, a production stinger conduit 60 is connected to the production seal unit 50 in fluid communication with the coupling head production bore 54. The production stinger conduit 60 is coaxially received within the packer bore 20, and extends throughout its length. The annulus 62 between the packer bore 20 and the stinger conduit 60 defines a separate flow path which opens into the well casing annulus 12B below the packer 10. The production stinger conduit 60, on the other hand, defines a separate flow path through which formation fluid 64 is produced.

An annular coupling collar 66 is attached to the lower end of the twin coupling head 52 and is received in telescopic engagement with a landing bore 68 of the packer 10. Elastomeric seals 70 carried on the exterior of coupling collar 66 form a fluid barrier with bore 68 to prevent undesired fluid communication between the upper casing annulus 12A and the packer bore 20.

The small-diameter gas-lift flow passage 56 opens into the annulus 72 between the coupling collar 66 and the production stinger conduit 60. The coupling collar annulus 72 opens directly in fluid communication with the packer annulus 62. By charging the upper annulus 12A with lift gas 46 through the well head valve 48, lift gas is admitted through the inlet port 44 of gas-lift safety valve 38 where it is conducted through conduit 58 and small diameter flow passage 56 into the coupling collar annulus 72. The flow of lift gas 46 continues through the packer annulus 62 defined between the packer bore 20 and production stinger conduit 60.

According to an important feature of the invention, mutually co-acting latching members, latch head 78 and detent groove 80, are carried by the production stinger conduit 60 and stinger nipple 76 respectively. The mutually co-acting latching members releasably secure the position of production seal unit 50 relative to the hanger packer 10. The annulus 82 between the production stinger conduit 60 and the stinger nipple 76 is sealed by annular seal elements 84. The annulus 86 between coupling collar 76C and stinger conduit 60 is in direct flow communication with packer annulus 62 and lower casing annulus 12B through discharge ports 74.

Figure 1B:
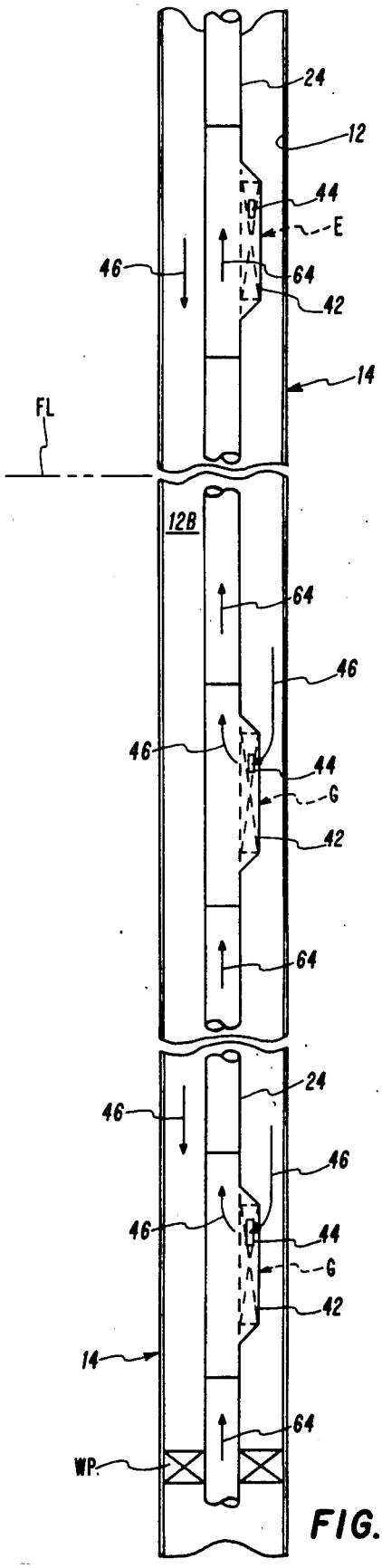
FIG. 1B is a continuation of FIG. 1A which illustrates the relative positions of an equalization valve and lift gas valves which are supported within the lower casing annulus below the single bore hanger packer.
Figure 7:
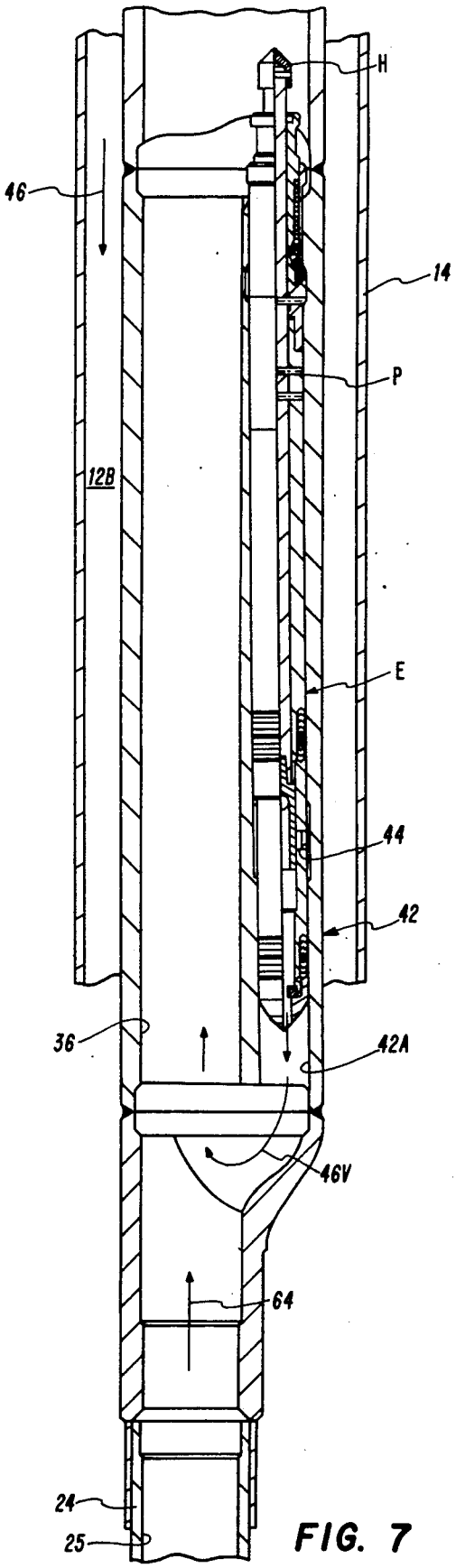

Referring now to FIGS. 1A, 1B and 7, the tailpipe production string 24 includes an equalization valve E mounted or releasably secured in a side pocket mandrel 42 of the type described above. The side pocket mandrel 42 includes a production bore 36 connected in communication with the bore 25 of production tubing 24, and an inlet port 44 which is normally closed by the equalization valve E. The side pocket mandrel in which the equalization valve E is mounted is disposed above the fluid level FL as can be seen in FIG. 1B. When it is desired to relieve the pressure within the lower casing annulus 12B, a wire line tool is inserted through the production tubing string 24 and is jarred down against the actuator head H which shears pins P, with the result that the body of the valve E is displaced downwardly through bore 42A of the side pocket mandrel 42, thereby opening inlet port 44 so that high-pressure gas 46 accumulated within lower casing annulus 12B is admitted into the mandrel bore 36 and is vented into the mandrel bore 36 as suggested by arrow 46V.

During the production mode of operation, the equalization valve E is closed, and lift gas 46 accumulates within the lower casing annulus 12B until a desired operating pressure level is achieved. Production of formation fluid 64 is enhanced by injecting the lift gas 46 into the column of formation fluid below the fluid level FL through one or more gas-lift valves G which are mounted onto the lower production tubing string below the hanger packer 10. It should be noted that, in a typical gas-lift installation, the equalization valve E will be positioned above the fluid level FL at a relatively shallow depth of 500 feet, more or less, whereas the gas-lift valves G will be located below the fluid level FL at much greater depths, for example 7,000–8,000 feet. Optional equipment such as a well packer WP is anchored within the lower casing annulus 12B below the gas-lift valves G.

The gas-lift valves G are received within a side pocket mandrel 42 of the type previously described. The side pocket mandrel 42 includes an inlet port 44 through which lift gas 46 is admitted from the lower casing annulus 12B. An example of a gas-lift valve G which is satisfactory for use in this invention is described in the aforementioned U.S. Pat. No. 4,294,313 to Harry E. Schwegman. Gas-lift valve G is a check valve which can be inserted and removed from the side pocket mandrel as shown in the Schwegman patent. Gas-lift valve G permits the flow of high-pressure lift gas 46 from the lower casing annulus 12B into the bore of the production string 24, but blocks the flow of fluids in the reverse direction through port 44.

Formation fluid 64 enters the bore 25 of lower production tubing string 24 and is conducted upwardly through the bore 60A of the production stinger conduit 60. The stinger conduit 60 opens into direct fluid communication with the lower production string 24 which is hung-off of the stinger nipple 76. The upper end of the stinger conduit 60 is joined in fluid communication with the bore 25 of upper tubing production string 24 at the production seal unit 50. The packer annulus 62 between the packer bore 20 and the stinger conduit 60 is connected through the mandrel ports 74 in direct fluid communication with the lower casing annulus 12B. The lower casing annulus 12B becomes charged to an appropriate pressure level for providing lift gas assistance for producing formation fluid 64 through the production tubing 24.

According to the foregoing arrangement, the bore 60A of stinger conduit 60 has the same effective flow diameter as the bore 25 of production tubing 24. A large annular flow passage area 62 is defined between the stinger conduit 60 and the packer bore 20 which will accommodate large-volume gas-lift operations without imposing a production flow limitation through the packer. Because the flow passage defined by production stinger conduit 60 is not restricted, service tools of a standard size can be extended throughout the length of the well for performing service operations in which the production tubing and completion bore are traversed by a tool for cleaning, bailing, swabbing, running corrosion or pressure surveys, and the like.

Figure 5:
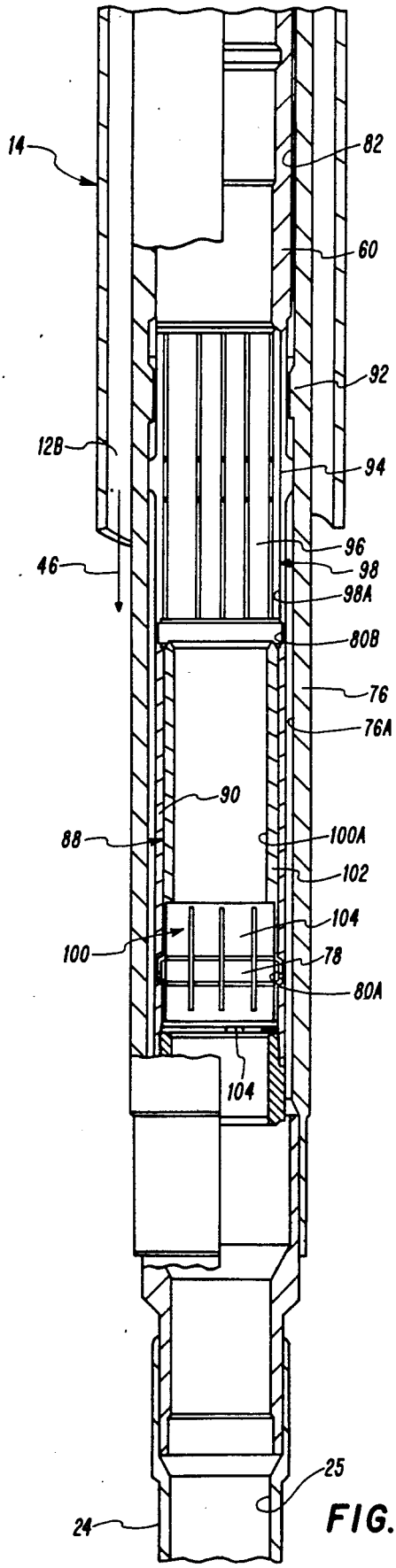
FIG. 5 is a view, partly in elevation and partly in section, illustrating the relative positions of a movable collet latch in the unlocked, run-in position.
Figure 6:
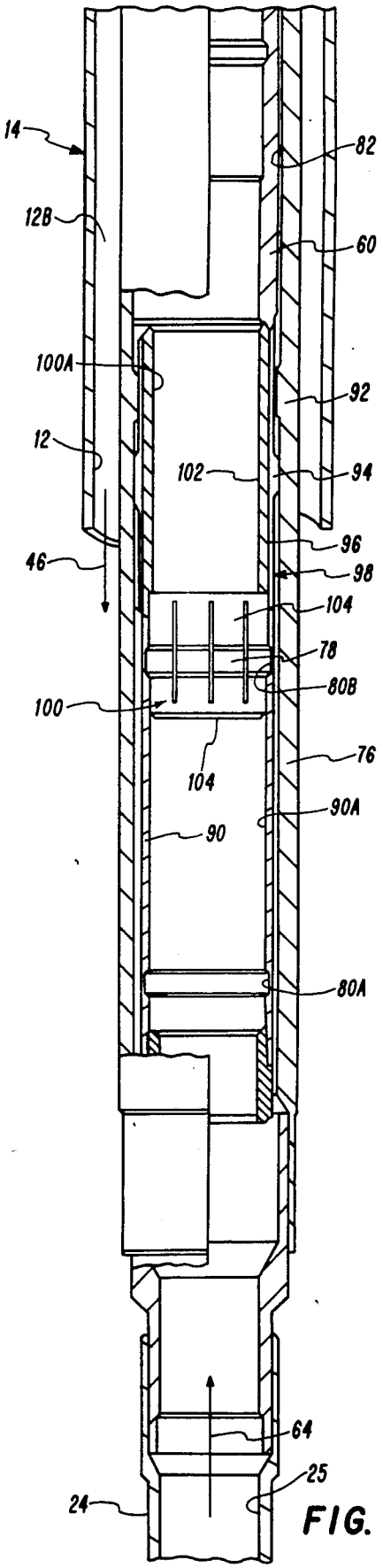
FIG. 6 is a view similar to FIG. 5 in which the collet latch has been moved to its locked, operating position; and, FIG. 7 is a view, partly in elevation and partly in section, illustrating details of the equalization valve shown in FIG. 1B.

Referring now to FIGS. 1A, 5 and 6, the position of production seal unit 50 relative to the hanger packer 10 is secured by a latch assembly 88. The latch assembly 88 includes a latch mandrel 90 which is attached to the lower end of the production conduit stinger 60. The bore 90A of mandrel 90 is coupled in fluid communication with the bore 25 of production conduit string 24. Annular locator grooves 80A, 80B are formed within the mandrel bore 90A at axially-spaced locations.

An annular locator ring 92 is carried by the stinger nipple 76 and projects radially into the nipple annulus 82. The annular locator ring 92 is engagable with collet heads 94 which are formed on flexible fingers 96 mounted on a fixed collet assembly 98, and are designed to deflect radially inwardly. The fixed collet assembly 98 is connected intermediate the stinger conduit 60 and the latch mandrel 90 and forms an extension thereof.

Slidably received within the latch mandrel bore 90A is a reciprocating collet assembly 100 which is received for axial reciprocal displacement within the bore 90A from a first position, as shown in FIG. 5, wherein the flexible fingers 96 of the fixed collet assembly 98 are free to deflect radially inwardly to permit displacement of the collet heads 94 by the annular locator ring 92, to a locked position as shown in Figure 6, in which the flexible fingers 96 are supported against radial deflection, with the result that the collet heads 94 are brought into locking engagement with the annular locator ring 92 upon an upward excursion of the production tubing string 24. The reciprocating collet assembly 100 includes a cylindrical sleeve or barrel 102 which supports a plurality of flexible collet fingers 104. The collet latch heads 78 project radially from the flexible fingers 104 and are received in detented engagement within the annular groove 80A. The movable collet latch assembly 100 has a bore 100A through which formation fluid 64 is produced from the lower production string 24.

Prior to insertion into the well bore, the movable collet assembly 100 is positioned in the production conduit stinger bore 60A until the collet heads 78 are received within the annular detent groove 80A. In this position, the barrel 90 of the movable collet assembly 100 is retracted away from the flexible fingers 96 of fixed collet 98. Accordingly, when the stinger conduit 60 is inserted into the nipple 76, the fingers 96 deflect radially inwardly, permitting the collet heads 94 to pass over the annular locator ring 92, as the production seal unit 50 is inserted into the packer landing bore 68.

Accurate positioning of the production seal unit 50 within the packer landing bore 68 is provided by retracting the movable collet assembly 100 to the locked position as shown in FIG. 6. The retracted position of movable collet assembly 100 is achieved with the aid of an up-shifting tool of the type described in U.S. Pat. No. 3,871,456 to Phillip S. Sizer et al, which is incorporated herein by reference. The shifting tool is connected to the lower end of a guide string, and includes a spear which is releasably engagable with an annular shoulder 104 of the movable collet 100.

As a retracting force is applied by the guide string, the movable collet 100 is shifted upwardly with the barrel 102 of the movable collet being inserted into the bore 98A of the fixed collet 98. As the movable collet 100 is retracted, the collet heads 78 deflect inwardly and move out of detented engagement with annular groove 80A. As the sleeve 90 is fully inserted into the bore 98A of fixed collet 98, the collet heads 78 are received in detented engagement in the upper annular groove 80B.

In the locked position (FIG. 6), the cylindrical barrel 102 of the movable collet assembly 100 supports the flexible fingers 94 of the fixed collet against radial deflection. Accordingly, the fixed collet heads 94 are brought into locking engagement with the annular locator shoulder 92 to limit upward excursions of the production seal unit 50 relative to the hanger packer 10. Release of the latch assembly 88 is obtained by shifting the movable collet 98 to the unlocked run-in position as shown in FIG. 5.

It will be appreciated that the well completion assembly, including the gas-lift safety valve, production safety valve, production seal unit and collet latch assembly can be made up and tested as a unit, and then run in and installed as a unitary assembly. Moreover, the completion assembly is tubing retrievable above the packer, with retrieval of the completion assembly being carried out without disturbing the packer or any of the equipment hung off of the packer. Both the main production flow and the annulus lift gas flow can be shut off automatically. When it is necessary to wire line service the lift gas safety valve, the high-pressure gas in the lower casing annulus is vented into the bore of the production tubing string through the equalization valve.

The completion assembly, including the production tubing, production safety valve and gas-lift safety valve can be installed by a straight stabbing maneuver which does not involve rotary manipulation of flow conductors in place in the well. The production stinger conduit extended through the bore of a large-diameter packer defines separate concentric flow passages for lift gas and production fluids substantially without limiting or restricting production flow, while simultaneously providing a large flow path for the lift gas through the annular passage between the stinger conduit and the packer bore.

Although the invention has been described with reference to a specific embodiment, and with reference to a specific gas-lift application, the foregoing description is not intended to be construed in a limiting sense. Various modifications to the disclosed embodiment as well as alternative applications of the invention will be suggested to persons skilled in the art by the foregoing specification and illustrations. It is therefore contemplated that the appended claims will cover any such modifications, applications or embodiments as fall within the true scope of the invention.

What is claimed is:

1. Well completion apparatus comprising, in combination:

a well packer comprising a mandrel, anchoring and sealing means for anchoring said mandrel in a well casing and sealing therebetween, said mandrel having a longitudinal bore communicating witht he casing annulus above the packer and below the packer;

a production seal unit having an annular coupling collar disposed for sealing engagement against the packer mandrel bore and a production stinger conduit for insertion into said packer mandrel bore, said stinger conduit having a bore defining a flow passage for formation fluid produced from said well, the annulus between the production stinger conduit and the packer bore defining an annular flow passage for conduit lift gas from the upper casing annulus into the lower casing annulus; and, said production seal unit including a coupling head having a production flow passage and a lift gas flow passage, said annular coupling collar being mounted onto said coupling head for insertion into the packer mandrel bore, said coupling collar carrying an annular seal for sealing the casing upper annulus with respect to the packer mandrel bore.

2. Well completion apparatus as defined in claim 1, including:

an upper production tubing string connected to said production seal unit and coupled in fluid communication with the production conduit stinger bore;

a surface-controlled, subsurface production safety valve interposed in said upper production tubing string, said production safety valve having a production flow passage communicating with said production tubing and a movable closure element for opening and closing said production flow passage; and, a surface-controlled, subsurface lift gas safety valve mounted onto said upper production tubing string, said lift gas safety valve having an inlet port for admitting lift gas from said upper casing annulus, flow passage means coupling the inlet port in communication with said packer annulus, and a valve closure element for opening and closing said flow passage means.

3. Well completion apparatus as defined in claim 1, including:

a lower production tubing string connected to said well packer and coupled in fluid communication with the production conduit stinger bore;

a normally-closed equalization valve assembly mounted on said lower production tubing string above the fluid level of the well, said equalization valve assembly having a production flow passage communicating with said lower production tubing string and having an inlet port communicating with the lower casing annulus, said equalization valve having a normally-closed valve closure element for blocking the inlet port and having a discharge port coupled in communication with the valve flow passage for conducting lift gas into the lower production tubing string upon opening of said valve closure element; and, a normally-open lift gas valve assembly mounted on said lower production tubing string below the fluid level of the well, said lift gas valve having an inlet port for admitting lift gas from said lower casing annulus, said valve being connected in fluid communication with the bore of the lower production tubing for conducting lift gas from the lower casing annulus into the lower production tubing string.

4. Well completion apparatus for use in combination with a well packer releasably anchored within a well casing, said packer having a bore communicating with the casing annulus above and below said packer, said completion apparatus comprising, in combination:

a production seal unit including a coupling head having a production flow passage and a lift gas flow passage, and a coupling collar for insertion into the packer bore, said coupling collar carrying an annular seal for sealing the casing upper annulus with respect to the packer bore;

a production stinger conduit connected to the production flow passage in said coupling head for insertion into said packer bore, said production stinger conduit providing a flow passage for producing formation fluid through said packer, and defining an annular flow passage between said stinger conduit and said packer bore for conducting lift gas through said packer and into the lower casing annulus;

a production tubing string attached to said coupling head in communication with said production flow passage;

a surface-controllable, subsurface safety valve connected into said production tubing, said safety valve having a production flow passage and a movable closure element for opening and closing said flow passage; and, a gas-lift safety valve mounted onto said production tubing, said gas-lift safety valve having a lift gas flow passage and a movable closure element for opening and closing the lift gas flow passage, said lift gas safety valve having an inlet port disposed in communication with the upper casing annulus for admitting lift gas, and having a discharge port coupled in communication with the lift gas flow passage in said coupling head for conducting lift gas from the upper casing annulus into the annular flow passage of said packer.

5. Apparatus for conducting formation fluid and lift gas through a well casing comprising, in combination:

a well packer including a mandrel, anchoring and sealing means for anchoring said mandrel in the well casing and sealing therebetween, said mandrel having a longitudinal bore communicating with the well casing annulus above and below said packer;

a production seal unit including a coupling head having a production flow passage and a lift gas flow passage, a first coupling collar attached to said coupling head for insertion into the upper end of said packer bore, and sealing means disposed between said first coupling collar and said packer mandrel for sealing the packer bore with respect to the upper casing annulus;

a stinger nipple attached to the lower end of said packer mandrel, said stinger nipple extending downwardly into the lower casing annulus;

a production stinger conduit connected to said coupling head and extending through said packer bore and through said stinger nipple; and, sealing means disposed within the annulus between said stinger nipple and said production stinger conduit for sealing said packer bore with respect to the bore of said production stinger conduit, said stinger nipple having a discharge port providing fluid communication between the packer annulus and the lower casing annulus.

6. The combination as defined in claim 5, including mutually co-active latch means mounted on said stinger nipple and said production stinger conduit for releasably securing the engagement of said production seal unit onto said packer mandrel.

7. The combination as defined in claim 5, wherein:

said stinger nipple includes an annular locator shoulder projecting radially into said flow passage; and, a collet latch assembly connected to said production stinger conduit and received within said stinger nipple, said collet latch assembly including a fixed collet and a movable collet, said movable collet being displacable within the bore of the fixed collet from a separated position in which the fixed collet is free to deflect, to a supporting position in which the movable collet engages the fixed collet to prevent deflection of the fixed collet, said fixed collet being engagable with the annular locator shoulder to prevent upward displacement of the production seal unit when the movable collet is in its supporting position.

8. The combination as defined in claim 7, said fixed collet having a latch mandrel supporting resilient finger members, each finger member having a radially-projecting head, with said resilient finger portions being adapted to deflect in response to radially-directed forces, and said radially-projecting heads being received within the bore of said stinger nipple and adapted to engage said annular locator shoulder upon retraction of said production stinger conduit through said packer bore; said movable collet including a cylindrical sleeve supporting resilient finger portions, each finger portion having a radially-projected head member, said fixed collet having first and second annular grooves formed in said latch mandrel, the movable collet being displacable within the bore of said fixed collet to a separated position in which the latch heads of said movable collet are received in detented engagement within the first annular groove, and the resilient fingers of the fixed collet are free to deflect, and said movable collet being displacable through said fixed collet to a supporting position in which the latch heads of said movable collet are received in detented engagement within the second annular groove, with the barrel of said movable collet being received within the deflection bore of said fixed collet, thereby preventing inward displacement of the flexible finger members of the fixed collet.

9. A method for producing a gas-lift well of the type having a casing and a well packer anchored in said casing comprising the steps:

running a string of production tubing including a stinger conduit into said well with said production stinger conduit extending through a flow passage bore in said packer, the bore of said stinger conduit defining a flow passage for conducting formation fluid through said packer, and the annulus between said packer bore and said stinger conduit defining an annular flow passage for conducting lift gas from the well casing annulus above the packer into the well casing annulus below the packer;

pressurizing the well casing annulus above the packer with lift gas;

discharging pressurized lift gas from the well casing annulus above the packer through a surface controllable safety valve into the annulus between the production stinger conduit and the packer bore;

conducting lift gas through said packer annulus and discharging it into the lower casing annulus;

discharging lift gas from the lower casing annulus into the production tubing through a gas lift valve attached to the production tubing at a location below the fluid level of the well; and, conducting formation fluid from said well through said production stinger conduit.

* * * * *

UNITED STATES PATENT AND TRADEMARK OFFICE

CERTIFICATE OF CORRECTION

PATENT NO. : 4,682,656

DATED : July 28, 1987

INVENTOR(S) : Fleming A. Waters

It is certified that error appears in the above-identified patent and that said Letters Patent is hereby corrected as shown below:

Column 1, line 42, "is" should read -- if --.

Column 3, lines 36-37, "tubingretrievable" should read -- tubing retrievable --.

Column 3, line 65, "Atatched" should read -- Attached --.

Column 4, line 44, "gaslift" should read -- gas-lift --.

Column 4, line 45, "pcocket" should read -- pocket --.

Column 5, line 51, "control ine" should read -- control line --.

Column 5, line 58, "valve" should read -- valves --.

Column 9, line 49, "witht he" should read -- with the --.

Column 9, line 60, "conduit" should read -- conducting --.

Signed and Sealed this

Twenty-fourth Day of November, 1987

*Attest:*

*Attesting Officer*

DONALD J. QUIGG

*Commissioner of Patents and Trademarks*